US008464896B2

(12) United States Patent
Beary

(10) Patent No.: US 8,464,896 B2
(45) Date of Patent: Jun. 18, 2013

(54) STRAW HOLDER FOR BEVERAGE CUP OR BEVERAGE CUP LID

(76) Inventor: Brian Beary, Palos Park, IL (US)

( * ) Notice: Subject to any disclaimer, the term of this patent is extended or adjusted under 35 U.S.C. 154(b) by 0 days.

(21) Appl. No.: 13/369,524

(22) Filed: Feb. 9, 2012

(65) Prior Publication Data

US 2012/0205389 A1 Aug. 16, 2012

Related U.S. Application Data

(60) Provisional application No. 61/441,481, filed on Feb. 10, 2011, provisional application No. 61/442,209, filed on Feb. 12, 2011, provisional application No. 61/442,217, filed on Feb. 12, 2011, provisional application No. 61/442,224, filed on Feb. 12, 2011, provisional application No. 61/442,189, filed on Feb. 12, 2011.

(51) Int. Cl.
*A47G 19/22* (2006.01)

(52) U.S. Cl.
USPC ..... 220/708; 220/705; 220/709; 220/710; 220/718

(58) Field of Classification Search
USPC ..... 220/718, 708, 705, 735, 709, 710
See application file for complete search history.

(56) References Cited

U.S. PATENT DOCUMENTS 2,395,734 A 2/1946 Georgopoulos
2,885,134 A 5/1959 Cohen
3,332,567 A 7/1967 Pugh
3,445,033 A 5/1969 Sweet
3,462,061 A 8/1969 Shore
3,623,632 A 11/1971 Chang
3,780,944 A 12/1973 Zubalik
3,874,554 A 4/1975 Chang
4,036,392 A 7/1977 Martin
4,095,710 A 6/1978 Tomiati
4,247,016 A 1/1981 Shaw
4,305,521 A 12/1981 Komatsuta
4,573,631 A 3/1986 Reeves
4,582,197 A 4/1986 Lin
4,728,001 A 3/1988 Serba
D296,664 S 7/1988 Hjalmarsson
D296,874 S 7/1988 Dallas
4,775,060 A 10/1988 Pinney
4,778,053 A 10/1988 Hakansson
4,850,495 A 7/1989 Wallace
5,048,709 A 9/1991 Alverson
5,054,631 A 10/1991 Robbins
5,178,354 A 1/1993 Engvall
5,325,982 A * 7/1994 Cobb, Jr. ..... 220/212.5
5,460,264 A 10/1995 Rupert
5,484,065 A * 1/1996 Davoli et al. ..... 211/65
5,544,783 A 8/1996 Conigliaro
5,558,247 A 9/1996 Caso (Continued)

*Primary Examiner* — J. Gregory Pickett
*Assistant Examiner* — Raven Collins
(74) *Attorney, Agent, or Firm* — The Gray Law Group, Ltd; Steven L. Fisher-Stawinski

(57) ABSTRACT

The invention is a container or container lid, including but not limited to a container or lid or container-lid combination of the kind commonly used to distribute bulk-dispensed beverages that features an integrated component used for attaching and holding a straw vertically to the outside of the container. The integrated component may be made a part of the container or a part of the lid, and may take any of a variety of shapes as described in the specification.

12 Claims, 5 Drawing Sheets

U.S. PATENT DOCUMENTS

| | | | | |
|---|---|---|---|---|
| 5,671,503 | A * | 9/1997 | Uebelacker et al. | 16/111.1 |
| 5,772,068 | A | 6/1998 | Hailey | |
| 5,782,358 | A | 7/1998 | Walker | |
| 6,116,446 | A | 9/2000 | Haughton | |
| 6,168,042 | B1 | 1/2001 | Kalagian | |
| 6,244,460 | B1 | 6/2001 | Winberg | |
| 6,269,985 | B1 | 8/2001 | Brody | |
| 6,315,152 | B1 | 11/2001 | Kalisz | |
| 6,412,671 | B1 | 7/2002 | Riley | |
| 6,494,332 | B1 | 12/2002 | Haughton | |
| 6,616,033 | B1 | 9/2003 | Schein | |
| 6,688,469 | B1 | 2/2004 | Barnes | |
| D517,913 | S | 3/2006 | Mouyos | |
| 7,225,937 | B2 | 6/2007 | Schroeder | |
| 7,845,145 | B2 | 12/2010 | Schroeder | |
| 7,845,513 | B2 | 12/2010 | White | |
| 2007/0170188 | A1 * | 7/2007 | Guillaume | 220/710 |
| 2008/0011909 | A1 | 1/2008 | Daddario | |
| 2012/0061409 | A1 * | 3/2012 | Fioritto et al. | 220/708 |

* cited by examiner

STRAW HOLDER FOR BEVERAGE CUP OR BEVERAGE CUP LID

CROSS-REFERENCE TO RELATED APPLICATIONS

This application constitutes a consolidation and non-provisional of and claims priority from the following five provisional patent applications, which are hereby incorporated by reference:

- U.S. Provisional Patent Application Ser. No. 61/441,481 filed 10 Feb. 2011
- U.S. Provisional Patent Application Ser. No. 61/442,189 filed 12 Feb. 2011
- U.S. Provisional Patent Application Ser. No. 61/442,209 filed 12 Feb. 2011
- U.S. Provisional Patent Application Ser. No. 61/442,217 filed 12 Feb. 2011
- U.S. Provisional Patent Application Ser. No. 61/442,224 filed 12 Feb. 2011

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to the field of containers and container covers, and more particularly to the field of containers and container covers featuring a structure for supporting a drinking straw external to the container.

For a number of practical and aesthetic reasons, many people enjoy consuming beverages through a straw. Conventionally, bulk beverages dispensed from a soda fountain are packaged on the fly in a disposable container fitted to a corresponding disposable lid which features a hole to accept a drinking straw. There are a number of common problems with this arrangement. One problem arises when drinks are being distributed to consumers by a service person for later consumption, as in a drive-through or fast food restaurant. In this situation, the beverage is generally packaged in cup and lid with the straw provided separately, often bagged with hot food. If the consumer wishes to drink the beverage before consuming the food (for example, while driving from the location of purchase to the location of consumption), then he must open the food container and look for the straw, thereby disturbing the contents and prematurely cooling it by releasing trapped heat. The simple alternative of placing the straw through the conventional lid hole creates the disadvantage that liquid, especially from a full container, can leak from around the lid hole when a straw is present, and the opening can accelerate the loss of carbonation in the beverage.

Various attempts to attach a straw to the cup generally prevent the stacking a fluid distribution of bulk beverages, which is critical to food service businesses that rely on rapid beverage deployment and the ability to greatly conserve space by stacking beverage containers and lids. Similarly, many designs are known in the prior art for attaching a straw to pre-packaged beverage containers, but pre-packaged beverages are generally not cost-effective for food service businesses as compared to bulk distribution via a soda fountain.

Conventional prior art designs have been proposed wherein a container or container cover is provided with a drinking straw attached thereto and available for to be inserted into the container at the time of use. Generally speaking, container cover designs have not offered a streamlined solution; prior art container cover designs are difficult to maintain or attach, and generally do not allow for easy and stable stacking. Similarly, container designs featuring a straw attachment have not offered a streamlined and minimized solution for attaching and holding a straw to a container. Some prior art solutions have straw holding components that are not an integrated part of the container itself.

In one class of examples, the prior art discloses containers that integrate a straw or tube into the exterior, but do not feature a removable lid and cannot be stacked or nested. For example, U.S. Pat. No. 5,460,264 issued 24 Oct. 1995 to Rupert teaches a sealed beverage container of molded plastic of the kind used for pre-packaged drinks that features a channel in the side where a drinking straw may be supported. Similarly, U.S. Design Pat. No. D517913 issued 28 Mar. 2006 to Mouyos teaches a semicircular support for a spray tube attached to the side of an aerosol spray can; U.S. Pat. No. 5,772,068 issued 30 Jun. 1998 to Hailey teaches an elongated cylindrical support for a spray tube attached to the side of an aerosol spray can; and U.S. Pat. No. 5,178,354 issued 12 Jan. 1993 to Engvall teaches a support for a spray tube constructed of opposing grip members attached to the side of an aerosol spray can. While all of these structures are directed to the problem of attaching a lightweight plastic tube, whether a drinking straw or a spray tube, to the side of a container, none are easily adapted to stackable containers because the involved containers—sealed drink containers of molded plastic and aerosol spray cans, are not themselves stackable nor are they frequently stored in an empty state separated from a lid, as with disposable beverage cups.

Even more troublesome for the user are structures that do not directly support a straw or spray tube, but instead require an additional attachment or apparatus to connect the straw or spray tube to the container for later use. In the field of aerosol spray cans, U.S. Pat. No. 6,412,671 issued 2 Jul. 2002 to Riley teaches a connector that encircles the spray tube and attaches by a string or line to a ring that encircles the aerosol spray can; U.S. Pat. No. 5,544,783 issued 13 Aug. 1996 to Conigliaro teaches a partially circular semi-flexible clip that attaches by tension to an aerosol can and supports a spray tube in a smaller partially circular clip on its outer circumference; and U.S. Pat. No. 5,558,247 issued 24 Sep. 1996 to Caso teaches a similar partially circular clip for an aerosol spray can. In the field of beverage containers, U.S. Pat. No. 2,395,734 issued 26 Feb. 1946 to Georgopoulos teaches a milk container that features a drinking straw tied to the top of the container by a waxed string; U.S. Pat. No. 5,325,982 issued 5 Jul. 1994 to Cobb teaches a bulky beverage cup handle capable of retaining a drinking straw; U.S. Pat. No. 4,850,495 issued 25 Jul. 1989 to Wallace, U.S. Pat. No. 4,775,060 issued 4 Oct. 1988 to Pinney, and U.S. Patent App. Pub. No. US 2008/0011909 published 17 Jan. 2008 of Daddario all teach clips of various kinds that retain a drinking straw on the side of a cup. All of the above apparatus are fiddly, cannot be deployed on stackable container or container lid, and are not streamlined for repeated deployment, as in a commercial establishment selling beverages in disposable containers.

The prior art also teaches a number of generally inadequate apparatus for integrating a drinking straw into a disposable beverage container or lid. This generally involves bending the straw around itself to make it more compact, however a bent straw, even with appropriately corrugated sections, can be fiddly to remove and may run a high risk of being damaged by the user while removing it. Damage to a drinking straw often results in a small centrally located hole that renders the whole straw no longer airtight and no longer usable for sucking liquids. For example, U.S. Pat. No. 4,036,392 issued 19 Jul. 1977 to Martin teaches a straw that is bent around double and embedded into a recess in a beverage container lid; U.S. Pat. No. 4,573,631 issued 4 Mar. 1986 to Reeves teaches a beverage container with integrated lid and external compartment containing a folded straw; U.S. Pat. No. 6,168,042 issued 2 Jan. 2001 to Kalagian teaches a beverage container with a circumferential or partially circumferential straw attached to the exterior of the container; and U.S. Pat. No. 4,247,016 issued 27 Jan. 1981 to Shaw teaches a straw circumferentially embedded in a beverage container lid and extending down into the container to form an integral straw apparatus. As above, all of these designs require great dexterity and fiddling by the user to free and use the straw, all at the risk of damaging the straw and rendering it useless.

U.S. Pat. No. 5,048,709 issued 17 Sep. 1991 to Alverson, directed at re-sealing previously sealed beverage containers (e.g. a common aluminum beverage can), teaches a cover for a previously sealed beverage container that features a ring attachment to retain a straw vertically exterior to the container, the straw being encircled by a second ring that attaches a cap for the straw opening. Besides being maladapted to a disposable never-sealed bulk beverage container, the Alverson apparatus requires the careful removal and replacement of the straw through a substantially rigid opening in the beverage container cover and the careful positioning of an easily-lost cap over the opening in the beverage cover. Regardless of the Alverson apparatus's merits as applied to reclosing of originally sealed beverage containers, its features are evidently poorly adaptable for use in a disposable container for distributing bulk beverages.

The below discloses an invention that address the aforementioned problems with bulk beverage distribution and substantially improves upon the aforementioned and other prior attempts to address those problems.

SUMMARY OF THE INVENTION

Accordingly, the invention is a container or container lid, including but not limited to a container or lid or container-lid combination of the kind commonly used to distribute bulk-dispensed beverages that features an integrated component used for attaching and holding a straw vertically to the outside of the container. The integrated component may be made a part of the container or a part of the lid, and may take any of a variety of shapes, some of which are described in more detail below.

It is an object of the invention to provide an easy way to distribute a straw with a bulk-dispensed beverage without prematurely placing the straw through the customary hole in the beverage lid.

It is an object of the invention to provide a structure for the attachment of a straw to a beverage container or lid without impeding the easy stacking and storage of containers and lids.

It is an object of the invention to provide a straw-holding structure that is inexpensive to manufacture and easy to deploy in a high-volume commercial environment such as a fast food restaurant or other food service business.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Referring now to the invention in more detail, the invention is a container, container lid, or container-lid combination featuring a straw-supporting structure made an integral part of the container, container lid, or container-lid combination. Alternatively, the invention may be understood as a straw supporting structure that may be made a part of a container, a container lid, or a container lid combination.

The straw supporting structure is presently envisioned in three flavors, identified herein as "ring", "hook", and "semicircle" structures. In the ring structure, the shape of the straw holding component is enclosed and circular in shape so as to accommodate a straw of similar shape. In the hook structure, the straw holding component is open on one side, but closed on three sides in a hook-like configuration. In the semicircle structure, the straw holding component is open and semicircular in shape so as to accommodate a straw of circular shape.

In each of the below embodiments, there is shown a container with a removable lid, which attaches by tension to a lip structure around the circumference of the top opening of the container. Such lid and lip structures are well known in the prior art. In each embodiment, one of the above-described straw holding structures is described as being made an integral part of the container or lid. Where the structure is described as being made a part of the container, the structure should be understood to be protruding from the container's outer wall at any point along the vertical height of the container and extending vertically less than the full height of the container. Where the structure is described as being made a part of the lid, the structure is made a continuous part of the outer diameter of the lid and is of a lesser height than the outer circumference of the lid.

The construction of the invention is such that the container lid, with or without a straw-supporting structure is made of a plastic or other sufficiently sturdy material. Where the structure is made a part of the lid, the structure and lid may be made of the same or different materials and may be manufactured a single contiguous piece or may be manufactured as multiple pieces adhered to one another. Similarly, the container, whether featuring a straw-supporting structure or not, is made of a plastic, Styrofoam, treated paper or other sufficiently sturdy material, particularly those materials commonly used for the manufacture of disposable beverage containers. Where the straw-supporting structure is made an integral part of the container, the container and straw supporting structure may be made of the same or different materials and may be manufactured a single contiguous piece or as multiple pieces adhered to one another.

Figure 1:
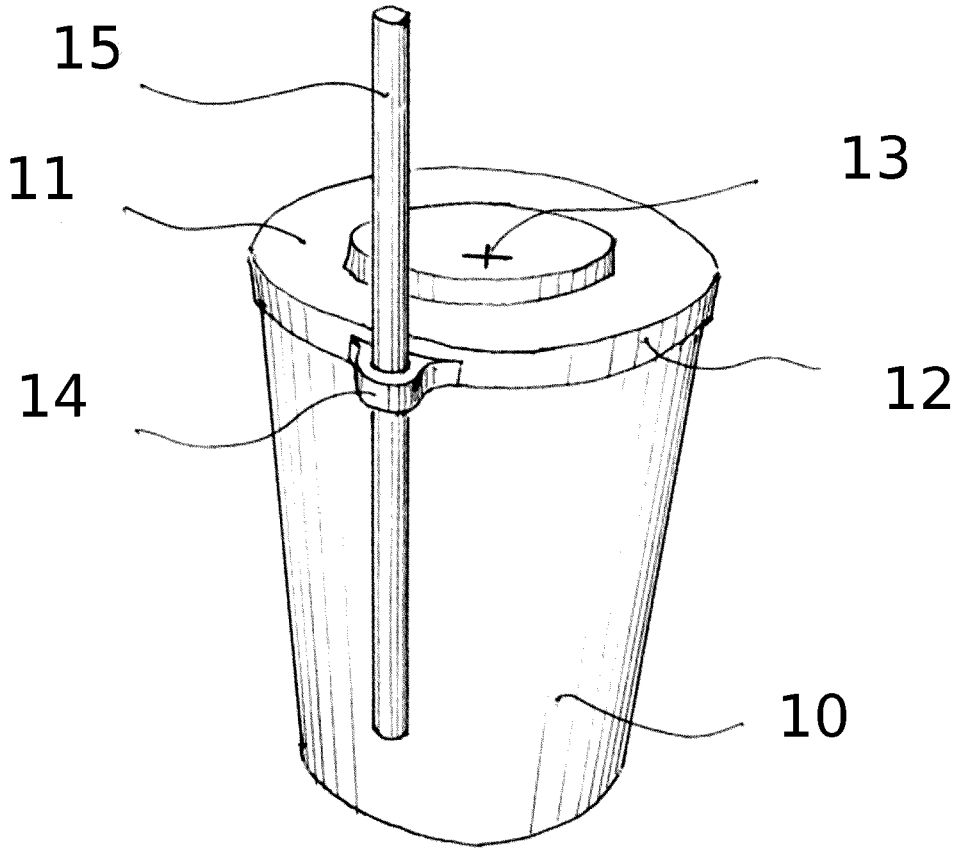
FIG. 1 shows a side elevated view of the first exemplary embodiment made a part of a beverage cup lid.
Figure 2:
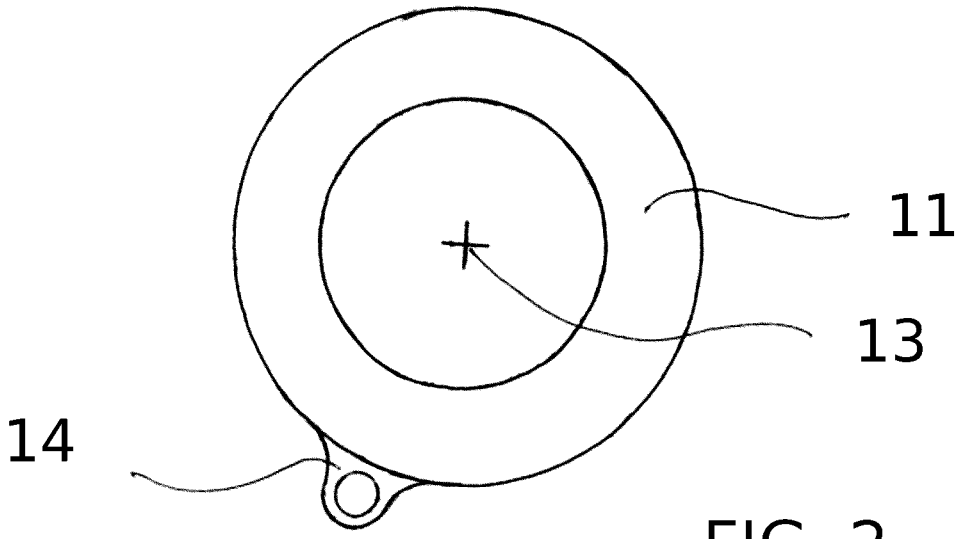
FIG. 2 shows a top view of the first exemplary embodiment.

Referring now to the first exemplary embodiment of FIG. 1 and FIG. 2, the first exemplary embodiment may be referred to as a ring structure made a part of a container lid. In the first exemplary embodiment, a container 10 is provided with a lid 11. The lid 11 has an outer vertical lip 12 and a straw hole 13 (the straw hole 13 being of the cross-cut type customarily used on conventional beverage lids. The straw supporting structure 14 supports a straw 15 inside a fully-enclosed circular opening sized to be approximately similar to the shape of the straw 15 such that the straw 15 may be slid into the straw supporting structure 14 from above or below and will be held securely in place there by friction.

Figure 3:
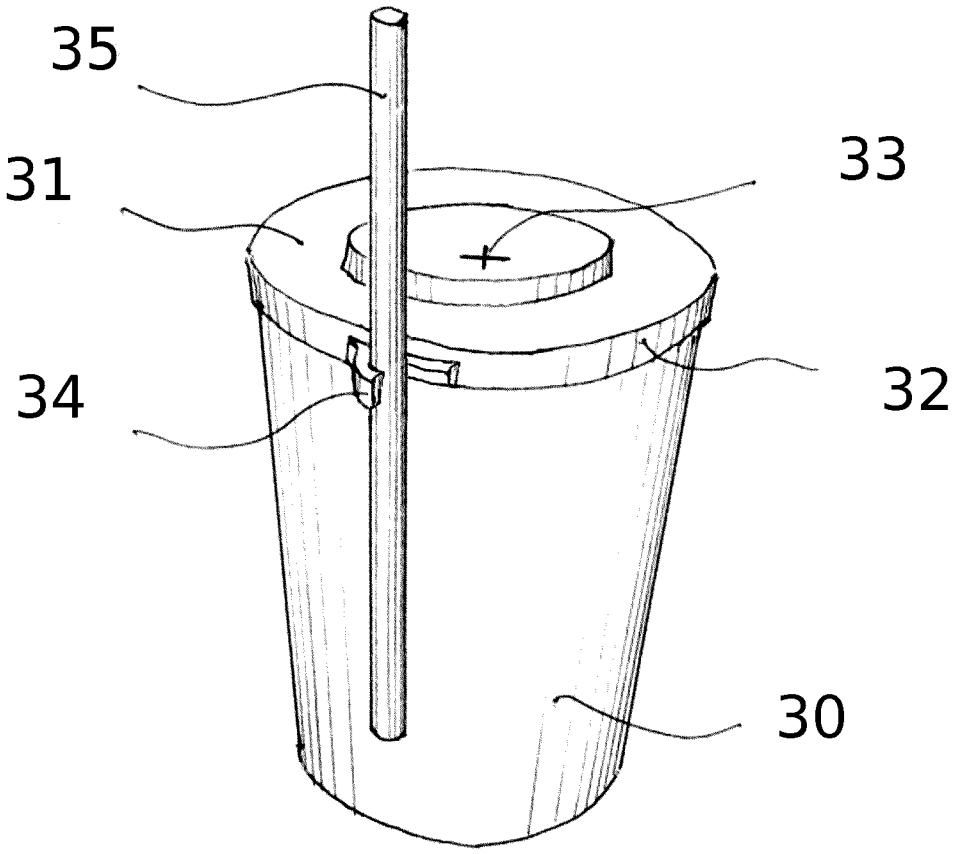
FIG. 3 shows a side elevated view of the second exemplary embodiment made a part of a beverage cup lid.
Figure 4:
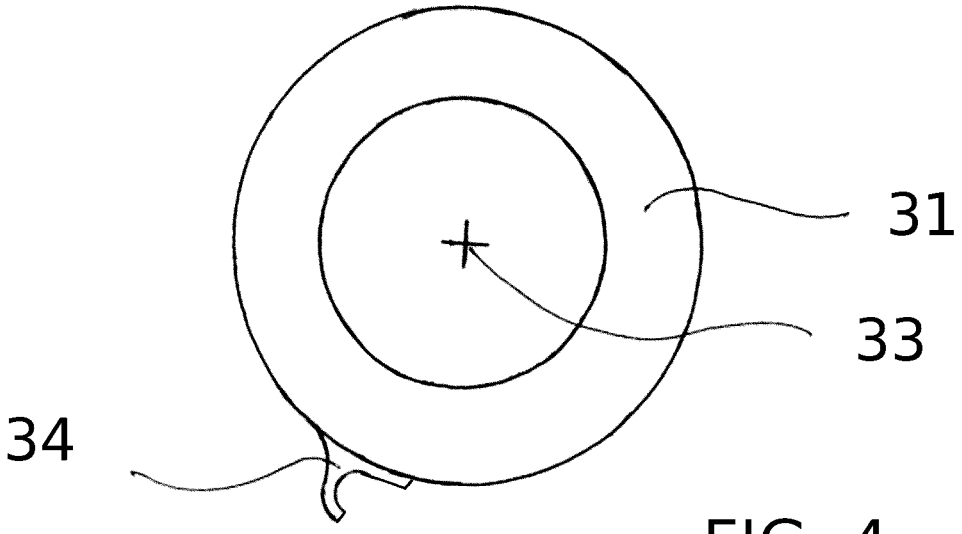
FIG. 4 shows a top view of the second exemplary embodiment.

Referring now to the second exemplary embodiment of FIG. 3 and FIG. 4, the second exemplary embodiment may be referred to as a hook structure made a part of a container lid. In the second exemplary embodiment, a container 30 is provided with a lid 31. The lid 31 has an outer vertical lip 32 and a straw hole 33 (the straw hole 33 being of the cross-cut type customarily used on conventional beverage lids. The straw supporting structure 34 supports a straw 55 inside a circular opening, the circular opening being open to one circumferential side, but closed to the other circumferential side and closed to the inner and outer radial sides with respect to the axial line of the container. The circular opening is sized to be approximately similar to the shape of the straw 35 such that the straw 35 may be placed inside of the straw supporting structure 34 by sliding from above or below or by being pressed from the open circumferential side and will be held securely in place there by friction.

Figure 5:
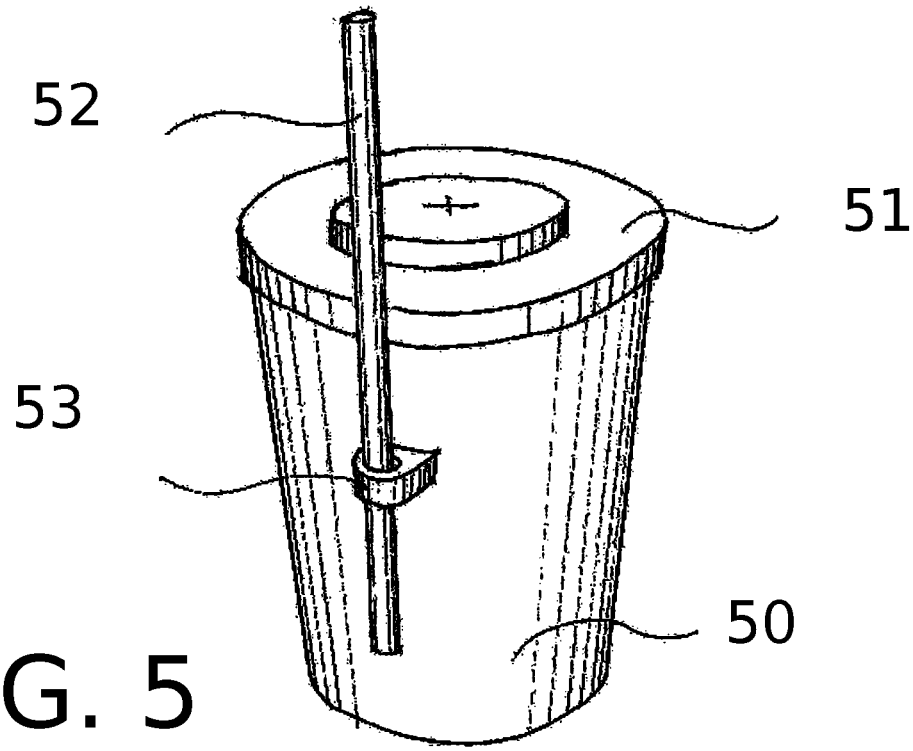
FIG. 5 shows a side elevated view of the third exemplary embodiment made a part of a beverage cup.
Figure 6:
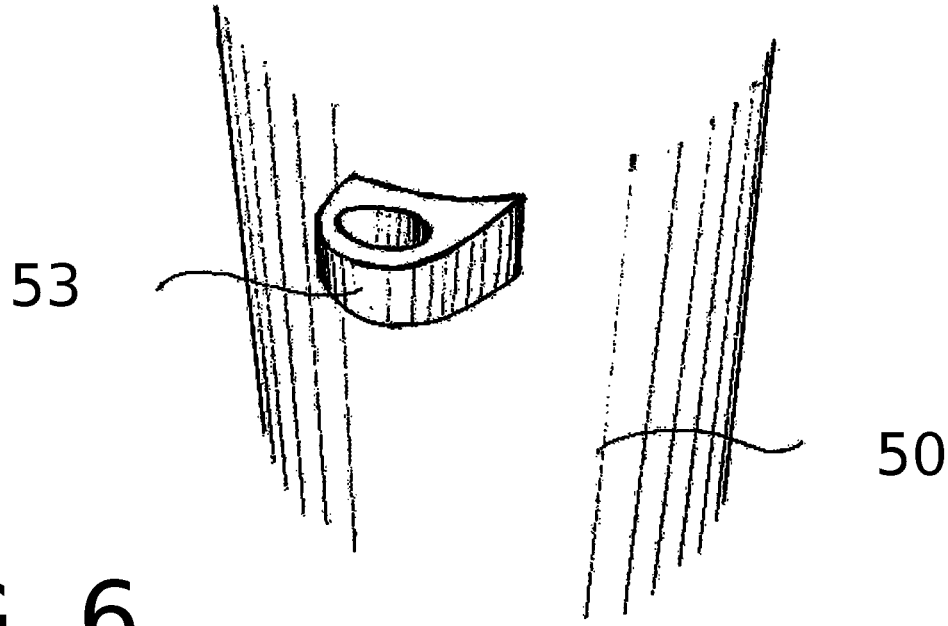
FIG. 6 shows close-up view of the third exemplary embodiment.

Referring now to the third exemplary embodiment of FIG. 5 and FIG. 6, the third exemplary embodiment may be referred to as a ring structure made a part of a container. In the third exemplary embodiment, a container 50 is provided with a lid 51. Built into one side of the wall of the container 50 is a straw supporting structure 53. The straw supporting structure 53 supports a straw 52 inside a fully-enclosed circular opening sized to be approximately similar to the shape of the straw 52 such that the straw 52 may be slid into the straw supporting structure 53 from above or below and will be held securely in place there by friction.

Figure 7:
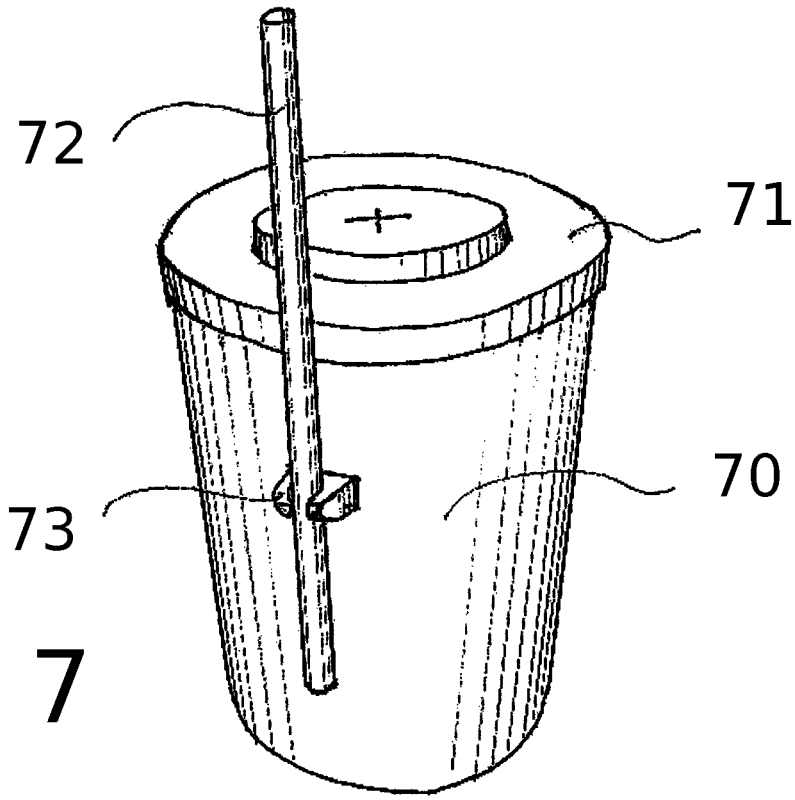
FIG. 7 shows a side elevated view of the fourth exemplary embodiment made a part of a beverage cup.
Figure 8:
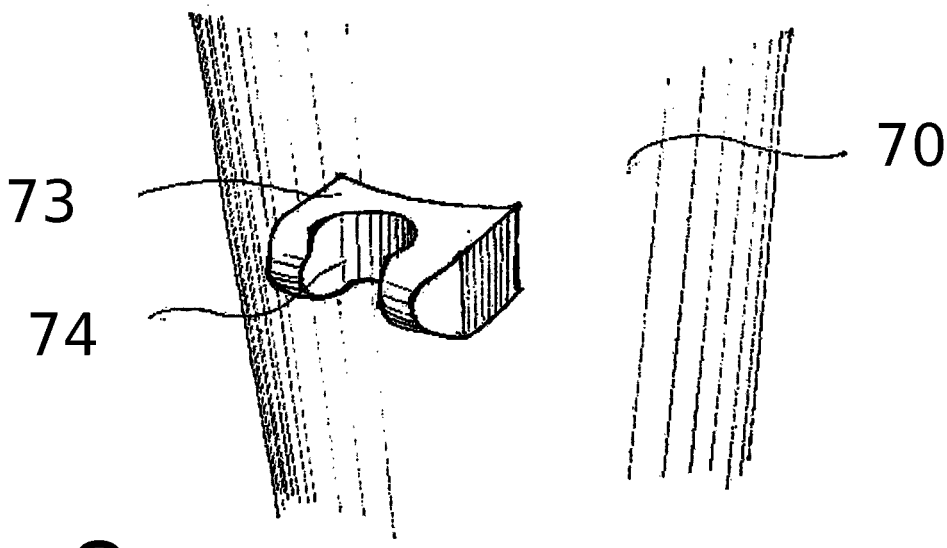
FIG. 8 shows a close-up view of the fourth exemplary embodiment.

Referring now to the fourth exemplary embodiment of FIG. 7 and FIG. 8, the fourth exemplary embodiment may be referred to as a semicircle structure made a part of a container. In the fourth exemplary embodiment, a container 70 is provided with a lid 71. Built into one side of the wall of the container 70 is a straw supporting structure 73. The straw supporting structure 73 supports a straw 72 inside a partial circular opening 74 closed to both circumferential sides and the radial inside, but open to the radial outside. The circular opening 74 is sized to be approximately similar to the shape of the straw 72 such that the straw 72 may be slid into the straw supporting structure 73 from above or below or pressed in from the radial outside and will be held securely in place there by friction.

Figure 9:
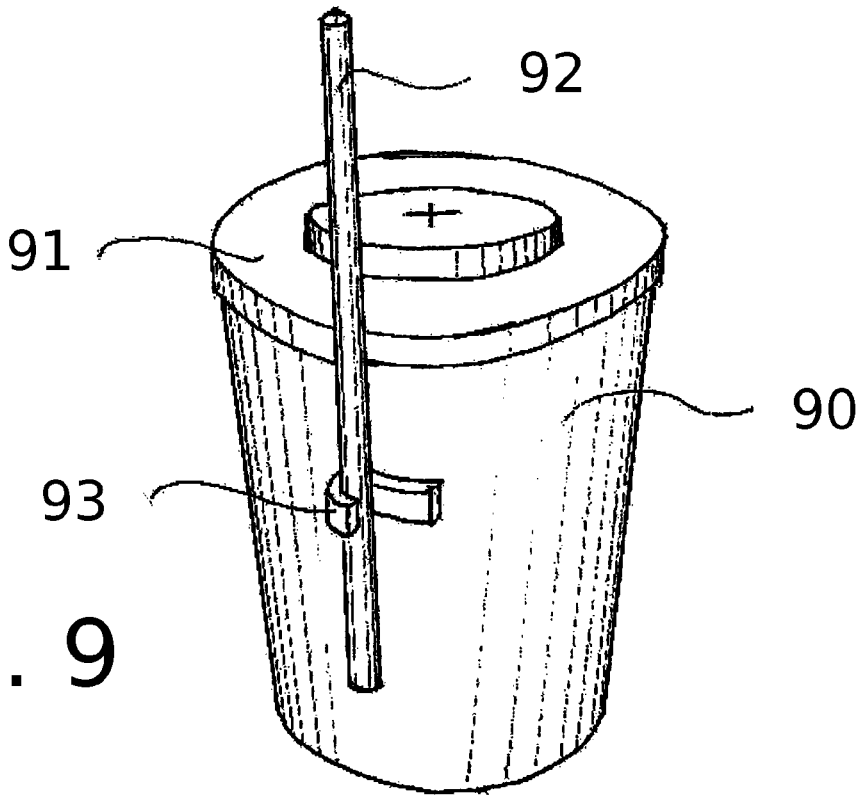
FIG. 9 shows a side elevated view of the fifth exemplary embodiment made a part of a beverage cup.
Figure 10:
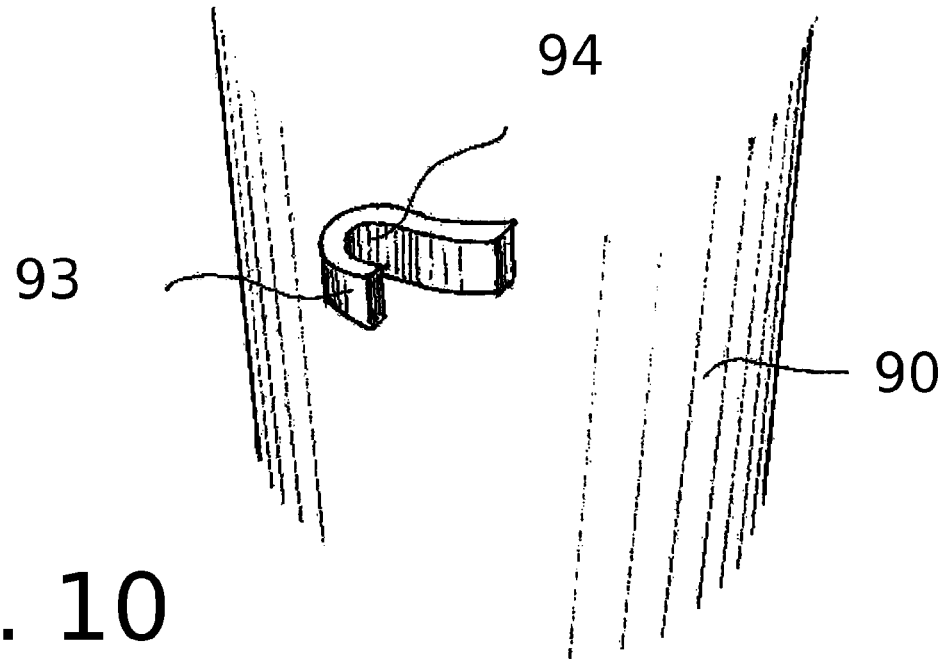
FIG. 10 shows a close-up view of the fifth exemplary embodiment.

Referring now to the fifth exemplary embodiment of FIG. 9 and FIG. 10, the fifth exemplary embodiment may be referred to as a hook structure made a part of a container. In the fifth exemplary embodiment, a container 90 is provided with a lid 91. Built into one side of the wall of the container 90 is a straw supporting structure 93. The straw supporting structure 93 supports a straw 92 inside a partial circular opening 94 closed to both the inner and outer radial sides and one circumferential side, but open to the second circumferential side. The circular opening 94 is sized to be approximately similar to the shape of the straw 92 such that the straw 92 may be slid into the straw supporting structure 93 from above or below or pressed in from the open circumferential side and will be held securely in place there by friction.

The foregoing structures provide a support for an attached straw, thus enabling a container to be easily and fluidly distributed with a straw. Embodiments featuring a straw support structure on a container lid offer easily stackable straw supporting lids, and embodiments that feature a straw support structure on a container offer easily stackable straw supporting containers, though to achieve this a low profile or high mount point for the straw support structure may be employed to ensure that the containers may be made to fluidly stack.

The foregoing has described a number of straw-supporting structures in combination with generally circular-cylindrical containers and lids of the type commonly used for distribution of bulk beverages. While this context of use and shape of container is presently envisioned, the invention may be applied to containers that have a non-circular cross section and are employed for purposes other than bulk beverage distribution.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A container for holding non-pressurized liquids comprising:

a. a watertight bottom;

b. at least one watertight side;

c. at least one structure attached to the exterior surface of said side;

d. said structure being capable of retaining a cylindrical object in approximately vertical position;

e. said structure having a height less than the height of said container;

f. said structure being a generally semicircular protrusion;

g. said protrusion having a vertically oriented circular hole;

h. said hole being at least partially surrounded by the material of said structure;

i. said circular hole being of about the same diameter as said cylindrical object; and j. wherein said circular hole is surrounded by the material of said structure only on the circumferential sides of said hole with respect to the axial line of said container;

whereby said container may be paired with said retained cylinder by placing said cylinder such that said cylinder penetrates said structure via said circular hole.

2. A container for holding non-pressurized liquids comprising:

a. a watertight bottom;

b. at least one watertight side;

c. at least one structure attached to the exterior surface of said side;

d. said structure being capable of retaining a cylindrical object in approximately vertical position;

e. said structure having a height less than the height of said container;

f. said structure being a generally semicircular protrusion;

g. said protrusion having a vertically oriented circular hole;

h. said hole being at least partially surrounded by the material of said structure;

i. said circular hole being of about the same diameter as said cylindrical object; and j. wherein said circular hole is surrounded by the material of said structure only on one circumferential side and on both the inner and outer radial sides of said hole with respect to the axial line of said container;

whereby said container may be paired with said retained cylinder by placing said cylinder such that said cylinder penetrates said structure via said circular hole.

3. The container of claim 1 wherein said cylindrical object is a drinking straw.

4. The container of claim 2 wherein said cylindrical object is a drinking straw.

5. The container of claim 3 wherein said at least one side has a lip whereby a lid may be snapped onto the container.

6. The container of claim 4 wherein said at least one side has a lip whereby a lid may be snapped onto the container.

7. A container lid comprising:

a. a general shape in the horizontal plane able to be paired with a container having a particular shape;

b. a rim extending down from the outer edge of said lid such that said lid may be snapped onto said container;

c. at least one structure attached to the exterior surface of said rim;

d. said structure being capable of retaining a cylindrical object in approximately vertical position;

e. said structure having a height less than the height of said rim;

f. said structure being a generally semicircular protrusion;

g. said protrusion having a vertically oriented circular hole;

h. said hole being at least partially surrounded by the material of said structure;

i. said circular hole being of about the same diameter as said cylindrical object; and j. wherein said circular hole is surrounded by the material of said structure only on the circumferential sides of said hole with respect to the axial line of said container;

whereby said container lid may be paired with said retained cylinder by placing said cylinder such that said cylinder penetrates said structure via said circular hole.

8. A container lid comprising:

a. a general shape in the horizontal plane able to be paired with a container having a particular shape;

b. a rim extending down from the outer edge of said lid such that said lid may be snapped onto said container;

c. at least one structure attached to the exterior surface of said rim;

d. said structure being capable of retaining a cylindrical object in approximately vertical position;

e. said structure having a height less than the height of said rim;

f. said structure being a generally semicircular protrusion;

g. said protrusion having a vertically oriented circular hole;

h. said hole being at least partially surrounded by the material of said structure;

i. said circular hole being of about the same diameter as said cylindrical object; and j. wherein said circular hole is surrounded by the material of said structure only on one circumferential side and on both the inner and outer radial sides of said hole with respect to the axial line of said container;

whereby said container lid may be paired with said retained cylinder by placing said cylinder such that said cylinder penetrates said structure via said circular hole.

9. The container lid of claim 7 wherein said cylindrical object is a drinking straw.

10. The container lid of claim 8 wherein said cylindrical object is a drinking straw.

11. The container lid of claim 9 wherein said at least one side has a lip whereby a lid may be snapped onto the container.

12. The container lid of claim 10 wherein said at least one side has a lip whereby a lid may be snapped onto the container.

* * * * *